United States Patent [19]

Jelinek et al.

[11] Patent Number: 4,665,718

[45] Date of Patent: May 19, 1987

[54] CIRCULAR KNITTING MACHINE FOR THE PRODUCTION OF PLUSH GOODS

[75] Inventors: Jan Jelinek; Bohumir Matousek, both of Trebic, Czechoslovakia

[73] Assignee: ELITEX, koncern textilniho strojirenstvi, Liberec, Czechoslovakia

[21] Appl. No.: 748,541

[22] Filed: Jun. 25, 1985

[30] Foreign Application Priority Data

Jun. 25, 1984 [CS] Czechoslovakia ..... 4848-84

[51] Int. Cl.[4] ..... D04B 9/12; D04B 15/06

[52] U.S. Cl. ..... 66/9 R; 66/93; 66/107

[58] Field of Search ..... 66/9 R, 91, 93, 107, 66/108 R, 108 A

[56] References Cited

U.S. PATENT DOCUMENTS

| | | | |
|---|---|---|---|
| 1,716,450 | 6/1929 | Lawson | 66/108 R X |
| 4,020,653 | 5/1977 | Mishcon et al. | 66/93 |
| 4,346,572 | 8/1982 | Güvell | 66/93 |
| 4,535,608 | 8/1985 | Plath et al. | 66/9 R |

FOREIGN PATENT DOCUMENTS

| | | | |
|---|---|---|---|
| 2038376 | 6/1980 | United Kingdom | 66/107 |

*Primary Examiner*—Wm. Carter Reynolds

[57] ABSTRACT

A circular knitting machine for the production of plush goods by means of needles and cooperating sinkers created to form plush and plain loops. The invention improves fabric quality especially when using cotton thread to form plush loops by providing beside the sinker to form plush and plain loops, an auxiliary sinker with a nib to tighten the ready plush loops and with a notch to hold and to pull-down the plush loops from the sinker to form plush and plain loops.

5 Claims, 7 Drawing Figures

CIRCULAR KNITTING MACHINE FOR THE PRODUCTION OF PLUSH GOODS

This invention relates to a circular knitting machine for the production of plush goods by means of needles and cooperating sinkers which form plush and plain loops.

It is known that in small diameter knitting machines for knitting plush structure loop-forming sinkers are usually used to form and to knock-over the loops of ground fabric, and plush sinkers are used for plush loops. Because the loop-forming sinkers cooperate practically only with ground fabric, and the plush loops are therefore not cleared at all, it happens that the plush loops are deformed, loosened and appearance faults are thus created on both sides of the fabric. This is especially the case when using non-elastic thread, for example, cotton thread. Appearance faults are of two types depending upon the reason for their origin. A loosened plush loop is either taken-up again by the hook or by the latch of the needle and a long stitch is thus formed sometimes even over several rows, or when pulling the stitch over the closed latch on the hook of the needle the stitch is released from the plush thread and remains free on the fabric face side. The whole face side then displays impression of disarrangement.

The object of the invention is basically to eliminate said shortcomings. This is achieved so that beside the sinker to form plush and plain loops there is located an auxiliary sinker with a nib to tighten the ready plush loops and with a notch to hold and to pull the plush loops from the sinkers to form plush and plain loops.

The advantage of the invention is that the auxiliary sinker takes-up the plush loop by its nib from the foregoing row and tightens it; this insures that repeated taking-up of the loop by the needle hook does not take place. A further advantage consists in that due to mutual cooperation with the sinker to form plush and plain loops. the auxiliary sinker holds the newly formed plush loop by its notch so that repeated taking-up of the loop by the needle hook is avoided. The use of the invention is especially suitable when knitting cotton materials.

The device according to the invention is illustrated in an exemplary embodiment in the drawings. wherein.

Figure 5:
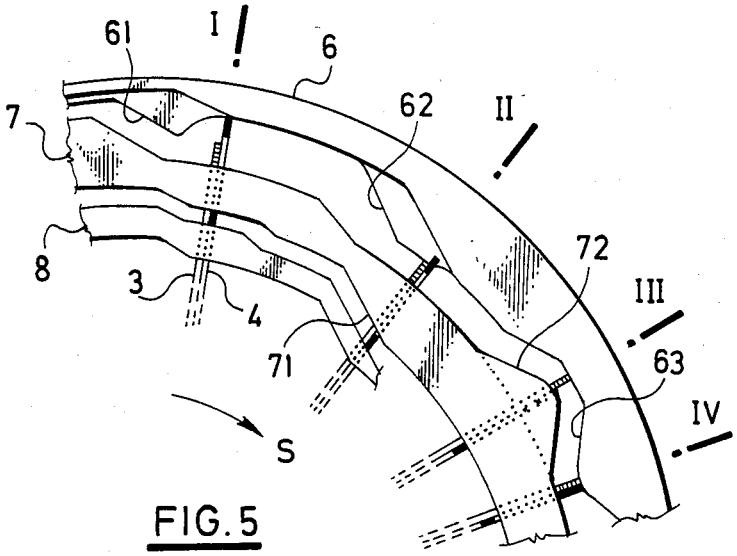
FIG. 5 is a top view of a part of the sinker cam rings in the sinker ring.

A known single-cylinder circular knitting machine for the production of hosiery goods is provided with a vertical rotatable needle cylinder 1 in the longitudinal vertical grooves of which there are mounted needles 2 which are reciprocated by a set or sets of stationary needle cams surrounding the needle cylinder. In accordance with the invention, the needles 2 cooperate with horizontally reciprocal sinkers 3 to form plush and plain loops, and with auxiliary sinkers 4. Sinkers 3 and auxiliary sinkers 4 are located together in one groove 18 in the upper end of the needle cylinder 1 and extend radially outwardly above a horizontally disposed sinker ring or dial 5 which is coaxial with the needle cylinder 1 and is mounted substantially on the level of the upper end of the needle cylinder. Sinkers 3 are provided with one butt 31 (FIG. 2) and the auxiliary sinkers 4 provided with two butts, a radially outer butt 41 and radially inner butt 42, butts 41 and 42 being lower than the butt 31. A stationary external cam ring 6 (FIG. 5) a central sinker cam ring 7, and an internal sinker cam segment 8, are fixedly mounted in a cover ring 9 served to control said butts 31, 41, and 42. The machine is provided with knitting feeds in which there are arranged guides 10 (FIG. 1) to lay the plush threads P, and guides 11 to lay the ground thread Z. Each sinker 3 is provided with an edge 32 to form plush loops. and with an edge 33 to form plain loops. Each auxiliary sinker 4 is provided with a nib 43 to tighten ready plush loop stitches; nib 43 is bevelled in an radially inward direction, opposite the direction of bevel of the nib 34 of the sinker 3. Both nibs 43 and 34 have the same height, but the nib 43 is longer in a radial direction than the nib 34. Further, each auxiliary sinker 4 is provided with a protrusion 44 in which there is formed a notch 45, the lower edge of notch 45 being at the level as the edge 32 of the sinker 3. The vertical edge of the notch 45 in protrusion 44 serves to hold and further to pull down the plush loops from the edge 32 of the sinker 3.

Figure 1:
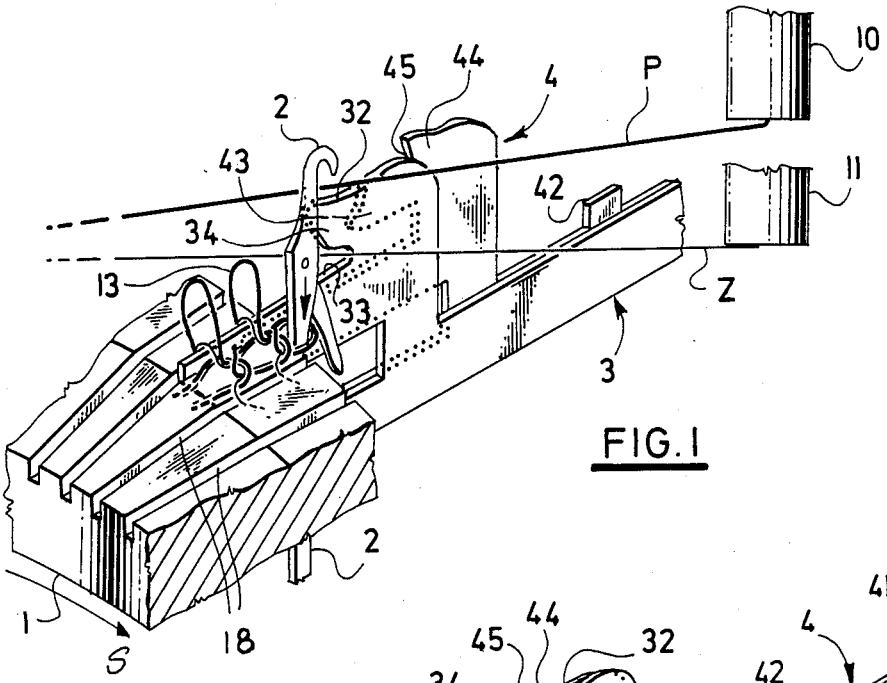
FIG. 1 shows in perspective the position of the sinkers and of the needle when laying the threads.
Figure 7:
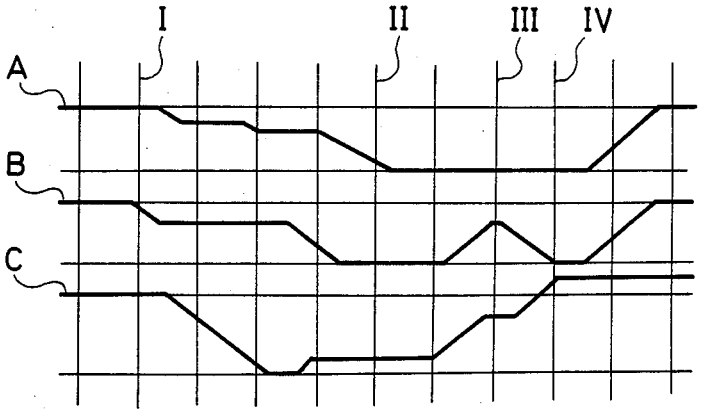
FIG. 7 illustrates schematically by means of curves the courses of the needles and of the sinkers.

When knitting plush fabric, the described apparatus operates as follows: When laying thread P and Z in the hooks of the needles 2, as depicted in FIG. 1 in the direction of rotation S of the needle cylinder, the auxiliary sinker 4 is disposed downstream of the sinker 3 so that it has no affect on the fabric because the sinker 3 was pushed by the edge 61 by means of a butt 31. The mutual positions of the butts 3 and 4 in place I (FIG. 5) when laying the threads P, Z is evident in the courses of the curves A, B, C (FIG. 7). Curve A shows the course of auxiliary sinkers 4, curve B shows the course of the sinker 3, and curve C shows the course of the needles 2.

Figure 2:
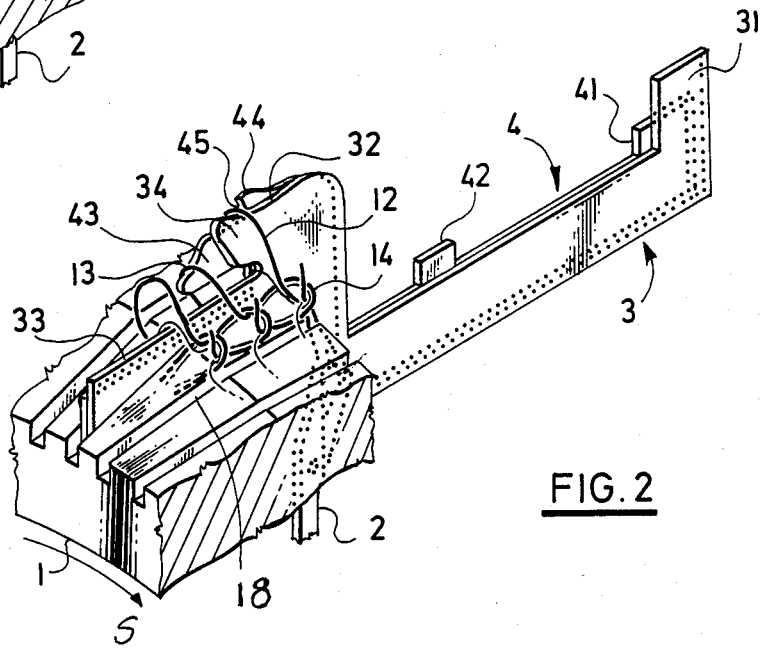
FIG. 2 shows in perspective the position of the sinkers and of the needle in the moment of maximum clearing.
Figure 3:
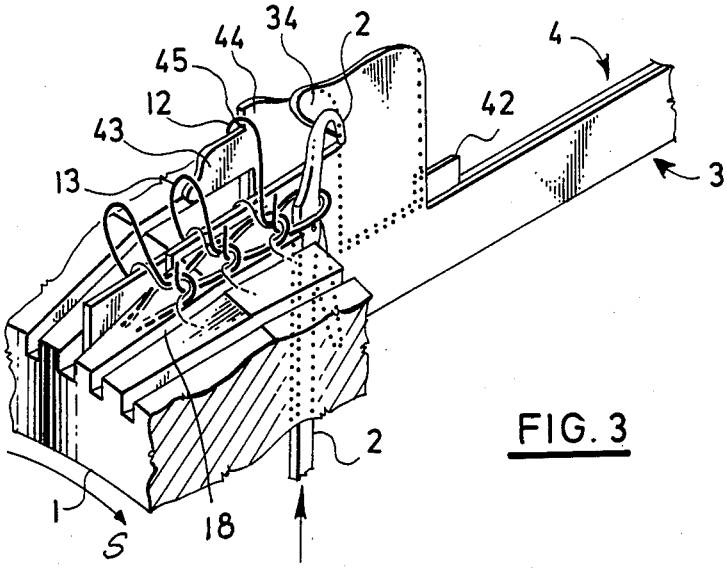
FIG. 3 shows in perspective the position of the sinkers and of the needle when transferring the plush loop onto the auxiliary sinker.

During travel from place I to place II, each needle 2 is completely clear, while a new plain loop and plush loop 12 are formed into which the nib 43 of auxiliary sinker 4 also penetrates, as evident from the course of curves A, B, and C as shown in FIG. 2. The sinker 3 and the auxiliary sinker 4 are thus pushed in, while the auxiliary sinker 4 is delayed, because the edge 71 which controls the butt 42 is downstream of the edge 62 which acts on the butt 31 of the sinker 3. Plush loop 13 formed in the forwarding row is also taken-up by the nib 43 of the auxiliary sinker 4 and tightened by the front bevelled edge. The final shape of the plush loop 13 is thus given, and loop 13 is also secured so that when raising the needle 2 the stitch 14 is not taken-up again on the hook of the needle 2. In the next phase of knitting, when raising the needle 2 in accordance with the curve C, the shifting in and out of the sinker 4 in accordance with the curve B takes place due the action of edges 72 and 63 of the central and external sinker cam rings 7 and 6, respectively. Due to the reverse motion of the sinker 3, the plush loop 12 is transferred onto the auxiliary sinker 4 into the notch 45 in the front of the protrusion 44, which corresponds to place III. and is shown in FIG. 3.

Figure 4:
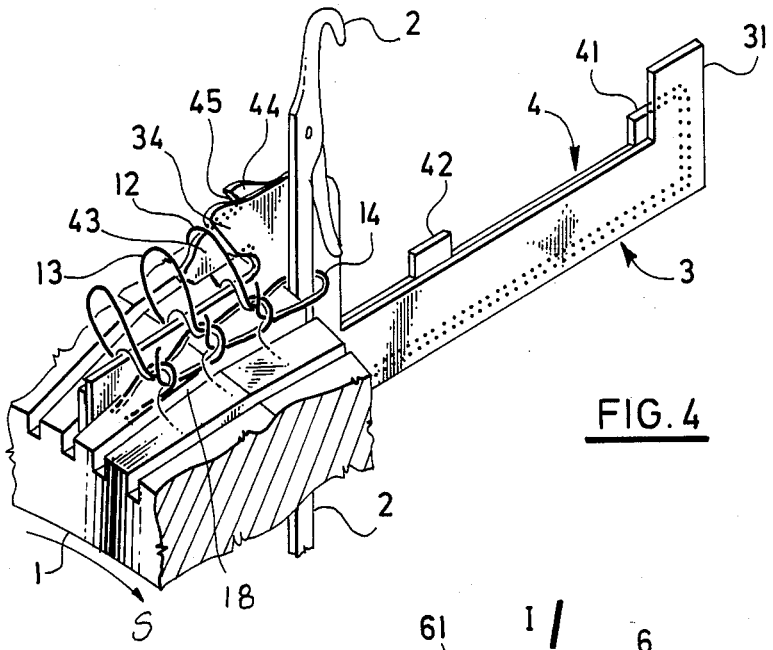
FIG. 4 shows in perspective the position of the sinkers and of the needle after tightening the plush loop.
Figure 6:
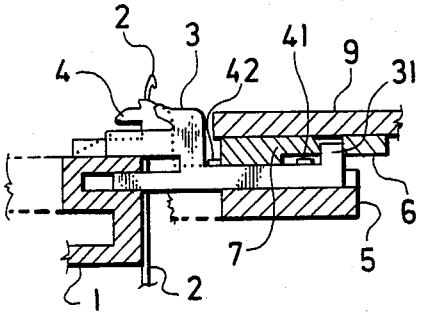
FIG. 6 is a view in partial axial section of the sinker ring with an illustrated location of the sinkers.

By the repeated motion of the sinker 3 in a radially outer direction. the plush loop 12 is moved onto the bevelled edge of the nib 43, and it is tightened; this takes place due the mutual cooperation of the auxiliary sinker 4 and the sinker 3, respectively, so that the nib 34 pushes the plush loop 12 forwardly out of the notch 45; this corresponds to place IV and is shown in FIG. 4. The plush loop 13 is moved forwardly from the reach of the nib 43 because a new row of loops was formed. This insures that, during the following clearing of the needle 2 the plush loop 12 is not taken-up by the latch of the needle 2.

Although the invention is described and illustrated with reference to a single embodiment thereof, it is to be expressly understood that it is in no way limited to the disclosure of such preferred embodiment but is capable of numerous modifications within the scop of the appended claims.

We claim:

1. In a circular knitting machine for the production of plush goods by means of the needles and cooperating sinkers created to form plush and plain loops, the machine having sinkers to form plush and plain loops, the improvement comprising auxiliary sinkers each with a nib to tighten the ready plush loops and with a notch in the nib having a vertical edge to hold and to pull down the plush loops from the sinkers to form plush and plain loops.

2. A circular knitting machine having a needle cylinder, according t claim 1, wherein the nib to tighten the ready plush loops is bevelled towards the center of the needle cylinder, while the level of the bevelled edge of the nib is angularly disposed relative to the level of the edge of the sinker to form plush loops.

3. A circular knitting machine according to claim 2, wherein the notch to hold and pull down the plush loops is formed by a horizontal edge, said horizontal edge serving as the upper edge of the nib to tighten the ready plush loops.

4. A circular knitting machine according to claim 3, comprising cam rings to control the sinkers to form plush and plain loops and auxiliary sinkers, wherein after the complete clearing of the needles, the edge of the sinker cam rings, which controls the sinker to form plush and plain loops, is arranged radially outward of the edge of the external sinker cam ring to control the auxiliary sinkers.

5. A circular knitting machine according to claim 4, wherein before the complete clearing of the needles the sinker cam rings are provided with edges to control the sinkers.

* * * * *